United States Patent [19]

Tschentscher

[11] 4,094,471

[45] June 13, 1978

[54] DEVICE FOR FEEDING THREAD INTO A TRAVERSING DEVICE IN A WINDING MACHINE

[75] Inventor: Alfred Tschentscher, Cologne, Germany

[73] Assignee: FMN Schuster & Co., Hurth-Efferen, Germany

[21] Appl. No.: 725,581

[22] Filed: Sept. 22, 1976

[30] Foreign Application Priority Data

Oct. 4, 1975 Germany ..... 2544538

[51] Int. Cl.[2] ..... B65H 54/02; B65H 54/34; B65H 54/20

[52] U.S. Cl. ..... 242/18 PW; 242/43 R

[58] Field of Search ..... 242/18 PW, 43 R

[56] References Cited

U.S. PATENT DOCUMENTS 3,908,917 9/1975 Tschentscher ..... 242/18 PW 3,960,336 6/1976 Tschentscher ..... 242/18 PW

FOREIGN PATENT DOCUMENTS 2,508,163 8/1975 Germany ..... 242/43 R

*Primary Examiner*—Stanley N. Gilreath
*Assistant Examiner*—John M. Jillions
*Attorney, Agent, or Firm*—Lowe, King, Price & Markva

[57] ABSTRACT

A device feeds thread into a winding and traversing mechanism of a winding machine. The thread is fed to a spool via a traversing device having a thread guide and a reverse thread roller. The start of the thread is fed to an entrainment means via a slot that is open at one end in the winding machine. The device is a combination which comprises a traversing device housing rotatably mounted on the winding machine and a mechanism for effecting rotatable adjustment of the housing about a longitudinal axis.

14 Claims, 3 Drawing Figures

DEVICE FOR FEEDING THREAD INTO A TRAVERSING DEVICE IN A WINDING MACHINE

BACKGROUND OF THE INVENTION

This invention relates to a device for feeding thread or yarn into a winding or traversing device in a winding machine. More particularly, the invention relates to an assembly having a traversing device and an associated spool forming a thread package or a plurality of traversing devices and spools arranged in an axial sequence. A particular type of housing configuration is used in combination with the winding machine.

Thread is fed to the spool of a winding machine from a supply device by means of a traversing device having a reciprocating thread guide. An insert slot is open at one end and extends along the length of the winding machine. At the start of winding, an end of the thread is fed along the insert slot. The spool may be driven by a spindle or by a friction roller which abuts the periphery of the spool or the periphery of the package of thread wound thereon.

Known winding machines are often made with two or more spools disposed in axial sequence on a mandrel. The mandrel is of an expanding type and it is possible to form two or more independent thread packages on the spools disposed therealong. Difficulties frequently arise in the fast and reliable handling of two threads coming from a supply device for starting the winding on the axially disposed spool. That is, it is difficult to have one thread go to one thread tube and the other to the adjacent thread tube without the threads interfering with each other. Since the threads are supplied continuously and at considerable speed, they cannot be dealt with manually. A suction gun providing a suction air stream is often used to grip and manipulate threse threads. The two threads hang relatively close to each other in these guns. Consequently, the separate feeding of the threads to the winding and traversing device is extremely difficult and tedious.

Attempts have already been made to prevent the threads from going to the same tube. A guide member has been disposed in the insert slot longitudinally of the mandrel and extending over the length of the first and leading spool. The guide member is used to keep the two threads separate during the insertion process. The guide member comprises a bar disposed in the insert slot above the transversing device. At its other end, the guide bar is bent back toward the rear traversing device to guide the second thread to the rear traversing device.

Such a guide member has been found inadequate. Through the guide bar, a step is formed at the end for guiding the second thread. The thread must be inserted quite rapidly when fed to the winding machine. The step in the guide bar causes the thread to be engaged directly by the thread feeder of the rear traversing device. That is, the step results in the thread not being taken up by the reserve winding device located behind the step in order to produce a reserve winding. The absence of a reserve winding during thread winding is unpleasant and disturbing due to the fact that automatic passage of the thread from one thread spool to another cannot be effected during removal of the thread into the processing machine. The working processes thus suffer an interruption resulting in a waste of time and money.

The operation of winding machines is generally well known as exemplified by U.S. Pat. Nos. 3,836,087, 3,884,426, 3,908,917, 3,908,919 and 3,960,336. These patents can be referred to for seeing how the various known elements such as traversing mechanisms, sensing elements, switches and reserve winding devices operate with respect to each other.

PURPOSE OF THE INVENTION

The primary object of this invention is to provide a means for threading a winding machine having one spool and a traversing device or at least two spools in axial sequence and a corresponding number of traversing devices.

Another object of this invention is to provide a mechanism for feeding a number of threads to corresponding traversing devices which are disposed adjacent a plurality of spools disposed in axial sequence along a winding machine.

A further object of this invention is to provide a means for feeding threads to a plurality of traversing devices corresponding to a plurality of spools disposed in axial sequence along the winding machine so that the rear threads reach the threading machine in suitable sequence and that the threads are acted upon by the reserve winding mechanism forming a reserve winding on each spool.

SUMMARY OF THE INVENTION

These objects and other advantages are accomplished by the assembly as described and disclosed herein. The winding machine includes a traversing device housing that is rotatably adjustable about its longitudinal axis. When there are a plurality of axially disposed traversing devices, at least the first one of the traversing devices adjacent the open end of the insert slot is provided with such a rotatably adjustable housing.

The rotatably adjustable housing for the traversing device provides adequate space between the traversing device on one side of the thread slot and members on the opposite side of the slot for take-up of the thread and reserve winding device. When the traversing device housing is rotated, the reciprocating thread guide mounted thereon is moved out of the area of the thread being inserted particularly where there is an outermost spool on which the thread is to be wound after initial starting and formation of the reserve winding. The rotation of the traversing device housing avoids the risk of the thread introduced being engaged by the thread guide before the reserve winding has been formed on the spool. Manipulation of two or more threads to be fed to appropriate spools is made much more reliable and easy. No thread guide which might prematurely engage the inserted thread is now operating in the path of insertion of that thread. Thus, the process of thread insertion is reliable and efficient.

Axially sequential devices may be jointly rotatable. The housing may be rotatable through an angle by an amount effective to cause the thread guide to lie outside a vertical plane tangential to the housings when the housing has been rotated. This precludes any risk of the thread guide engaging the inserted thread.

In a specific embodiment of the invention, the traversing device housing is rotatable between stops by means of a fluid pressure operated ram. Thus, the traversing device housing may include a bush having an arm pivotally connected to the ram. The bush arm may be movable between fixed stops which limit the rotary movement. When the traversing device is rotated to one position, the threads can run freely past the constantly reciprocating thread guides mounted on the housing.

The end positions of the rotatable housing may be determined by notches. In another feature of the invention, the traversing device housing is automatically rotated back to its working position once the inserted thread has been fed to to the device for forming the reserve winding. The insertion of the thread into the winding machine may be effected by an air stream.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DESCRIPTION OF SPECIFIC EMBODIMENTS

Figure 1:
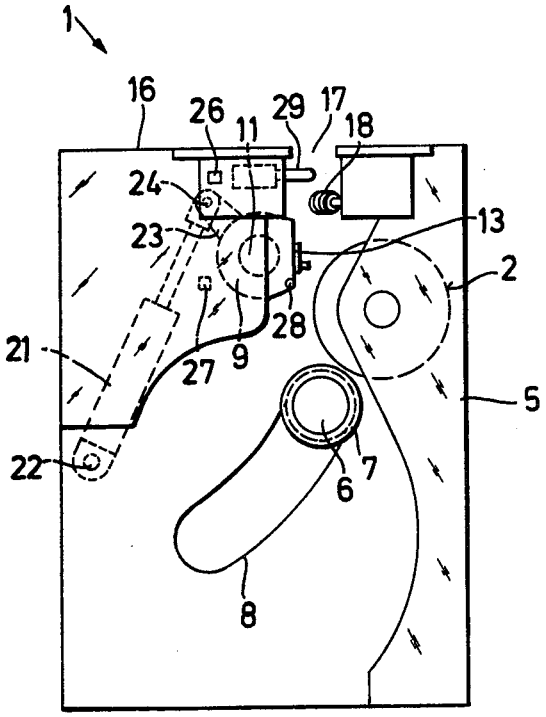
FIG. 1 is a front elevational view of a winding machine made in accordance with this invention showing the housings of the traversing devices in the positions in which the thread guides are in a thread-guiding position.

More specifically, referring to the drawings, a winding device, generally designated 1, has a driven-friction roller 2 mounted in a bearing 4 on a machine frame 5. The friction roller 2 may comprise a roller motor having electric supply leads 3. Spools 7 are mounted in axial sequence and alignment on a mandrel 6 which is an expanding mandrel in this specific embodiment. Friction roller 2 drives the mandrel 6 and the spools 7. Each thread package increase in size as it is formed on a spool 7 and has its periphery abutting the friction roller 2.

Mandrel 6 is disposed on a pivotal lever and can move in a slot 8 located in one wall of the winding machine as the diameter of the thread package increases. Two spools 7 can be fitted axially one after the other onto mandrel 6. The spools 7 are held in place by expansion of mandrel 6. Reverse thread rollers 11 and 12 are rotatably mounted in housings 9 and 10 having reciprocating thread guides 13 and 14, respectively. Reverse thread rollers 11 and 12 are mounted to correspond to the two sequentially disposed spools 7 on which are formed the two thread packages. A drive shaft 15 rotates the thread rollers 11 and 12.

A gap or slot 17 is located in an upper cover plate 16 of the winding machine. Slot 17 extends throughout the length of the axially spaced spools 7 and is open at one end **17*a* which constitutes its front end. The thread is affixed to the front ends of the adjacent spools 7. Devices 18 and 19 are provied at the front ends for forming reserve windings. Each of the reserve winding devices 18 and 19 constitutes entrainment means and comprises a rotary feed worm which is used to feed the incoming thread toward the respective reciprocating thread guides 13 and 14. The feed worms 18 and 19 first cause a reserve winding to be formed on spool 7. After the threads run off the feed worms 18 and 19, the threads move into the paths of the respective reciprocating thread guides 13 and 14. Consequently, the threads are then wound into thread packages on spool 7**.

Figure 2:
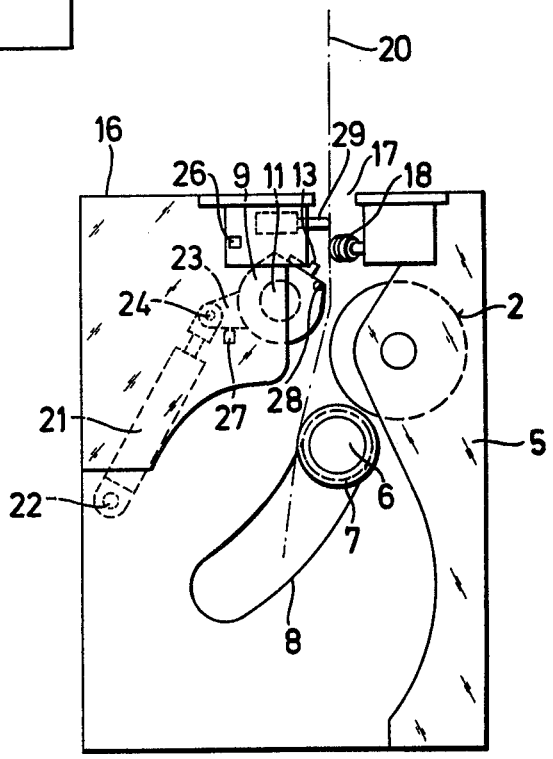
FIG. 2 is an elevational view as in FIG. 1, showing the housings of the traversing devices rotated so that the thread guides lie clear of the path of the thread being inserted.
Figure 3:
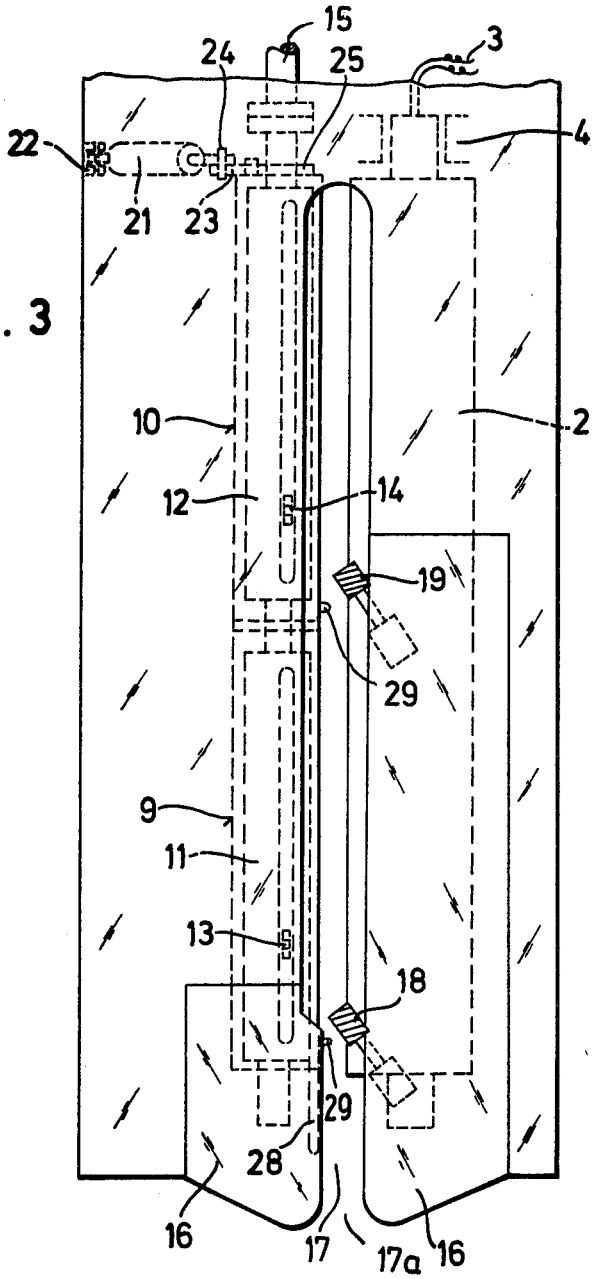
FIG. 3 is a top plan view of the machine as shown in FIG. 2.

The threads are supplied from a supply device or spinning unit and fed to the respective spool 7. The housings 9 and 10 are formed integrally or are connected together and are adapted to be rotatable through a predetermined angle. That is, the traversing device housing is rotatable through an angle such that the thread guide of the respective traversing device lies outside a vertical plane tangential to the housing. Thus, housings 9 and 10 can be turned from the positions shown in FIG. 1 to that shown in FIG. 2. Consequently, when the threads are brought into the slot 17 in the cover 16, they are not prematurely engaged by the thread guides 13 and 14. That is, the threads 20 entering the slot 17 do not enter the path of the reciprocating thread guides 13 and 14.

Housings 9 and 10 are readily turned or rotated about their longitudinal axis by ram 21 formed by a piston and cylinder device and actuated by a pressure fluid medium i.e., compressed air. Ram 21 is pivotally mounted at one end 22 on the machine frame 5 and pivotally connected at its other end 24 to an arm 23 which is attached by bush 25 to a bearing of housing 10. Stops 26 and 27 limit the rotary movements of housings 9 and 10 in respective opposite directions.

A guide finger 28 or a rail constitutes a projecting guide means and extends longitudinally and at the front end of the traversing device housing 9 which is near the open end of slot 17. The guide finger 28 facilitates insertion of thread 20 along the slot 17. Furthermore, an axially adjustable finger 29 is disposed in the vicinity of each of the reserve winding devices of feed worms 18 and 19. Each finger 29 may be pneumatically advanced and retracted. Fingers 29 serve to feed thread 20 supplied through slot 17 to the reserve winding devices 18 and 19. The setting of the fingers 29 is determined by the rotation of the traversing device housings 9 and 10. As soon as fingers 29 are retracted, the traversing device housings 9 and 10 are turned back into the operating position. After the reserve windings have been formed on spool 7, thread guides 13 and 14 then engage the incoming threads 20 forming packages on spool 7.

The rotational adjustment of the traversing device housings 9 and 10 may also be affected by hydraulically operated apparatus or electrical or magnetic means.

The rotational adjustment is realized in a synchronized system with the introduction of filament into the winding machine and its receipt by the spool 7.

While the device for feeding thread into a traversing device in a winding machine has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. A device for feeding thread into a winding and traversing mechanism of a winding machine having an entrainment means and a slot wherein the thread is fed to a spool via a traversing device having a thread guide and a reverse thread roller and the start of the thread is fed to said entrainment means via said slot that is open at one end in the winding machine, the combination comprising:

(a) a traversing device housing rotatably mounted on the winding machine; and (b) rotational adjustment means for rotating the housing about a longitudinal axis into an operating position wherein the traversing device is guiding the thread during the winding operation of said winding machine and out of said operating position before said guiding of the thread starts;

(c) said rotational adjustment means being effective to rotate the traversing device housing through an angle about said longitudinal axis when the start of said thread is brought into said slot;

(d) said angle being such that the thread guide of the traversing device lies outside a vertical plane tangential to said housing to prevent premature engagement of said thread by the thread guide.

2. A combination as defined in claim 1 wherein a projecting guide means is disposed at the end of the traversing device housing near the open end of said slot.

3. A combination as defined in claim 2 wherein said guide means is a projecting guide finger.

4. The combination as defined in claim 1 wherein stops are disposed on the winding machine; and the traversing device housing is rotatable between said stops.

5. The combination as defined in claim 1 wherein said rotational adjustment means comprises a fluid pressure operated ram.

6. The combination as defined in claim 5 wherein stops are disposed on the winding machine;

a bush having an arm and being disposed on the traversing device housing;

said arm being pivotally connected to said ram and being effective to engage said stops.

7. The combination as defined in claim 1 wherein there is a plurality of traversing devices with housings arranged end-to-end in axial alignment with respect to each other and a corresponding plurality of spools;

at least one of the housings is rotatably adjustable; and said transversing device having said rotatably adjustable housing being located nearest to the open end of said slot.

8. The combination as defined in claim 7 wherein each of said other traversing devices has a housing which is rotatably adjustable about its longitudinal axis.

9. The combination as defined in claim 8 wherein the housings are formed integrally and are connected together so as to be rotatably adjustable together.

10. A traversing device for a winding machine comprising:

(a) a reverse thread roller;

(b) a thread guide drivable by said roller to and fro axially of the roller; and (c) a roller housing having an axial slot through which the thread guides project;

(d) said housing being rotatably adjustable axially about said roller;

(e) a fluid pressure operated ram connected to said housing;

(f) said ram being effective to rotate the housing about a longitudinal axis into an operating position wherein the traversing device is guiding the thread during the winding operation of said winding machine and out of said operating position before said guiding of the thread starts;

(g) said housing being synchronously rotated with the introduction of the thread into the winding machine.

11. A combination as defined in claim 1 wherein the winding machine includes a reserve winding device and a movably adjustable finger means for feeding thread supplied through said slot to said winding device;

said finger means being movable between an advanced position and a retracted position;

said housing being rotated into said operating position when said finger means is in the retracted position.

12. A combination as defined in claim 11 wherein said finger means is axially adjustable.

13. The combination as defined in claim 11 wherein stops are disposed on the winding machine;

a bush having an arm and being disposed on the traversing device housing;

said arm being pivotally connected to said ram and being effective to engage said stops.

14. The combination as defined in claim 1 wherein the winding machine includes an axially adjustable finger means projecting into said slot and being movable between an advanced position and a retracted position;

said housing being rotated into said operating position when said finger means is in the retracted position.

* * * * *